United States Patent [19]

Stone et al.

[11] 4,336,802

[45] Jun. 29, 1982

[54] PARENTERAL SOLUTION CONTAINER FOR ASEPTIC MIXING

[75] Inventors: Albert J. Stone, Buffalo Grove; Michael D. Nissen, Crystal Lake, both of Ill.

[73] Assignee: Baxter Travenol Laboratories, Inc., Deerfield, Ill.

[21] Appl. No.: 172,893

[22] Filed: Jul. 28, 1980

[51] Int. Cl.[3] ..... A61J 1/00

[52] U.S. Cl. ..... 128/272; 128/DIG. 24

[58] Field of Search ..... 128/214 D, 214 R, 272, 128/1 R, 272.1, 272.2, DIG. 24

[56] References Cited

U.S. PATENT DOCUMENTS

| | | | |
|---|---|---|---|
| 90,235 | 11/1979 | Bellamy et al. . | |
| 91,688 | 11/1979 | Bellamy et al. . | |
| 968,241 | 12/1978 | DeVries et al. . | |
| 3,648,697 | 3/1972 | Gardner | 128/214 D |
| 3,746,001 | 7/1973 | Ralston | 128/214 D |
| 3,921,630 | 11/1975 | McPhee | 128/214 D |

*Primary Examiner*—Robert W. Michell
*Assistant Examiner*—T. J. Walley
*Attorney, Agent, or Firm*—P. C. Flattery; John P. Kirby, Jr.; Garrettson Ellis

[57] ABSTRACT

A flexible, flat-collapsible bag containing parenteral solution may be adapted for aseptically receiving and mixing the contents of another container, with the flat-collapsible bag preferably initially containing, prior to receiving said contents, a liquid for parenteral administration in a volume of 30 to 70 percent of the holding capacity of said flat-collapsible bag. The bag defines at least a pair of access ports, one of the ports being sealingly connected to flexible, crimpable, thermoplastic tubing of a length of at least 1½ inches, and a sealed connector member carried on the outer end of the flexible thermoplastic tubing, in which the seal connector member defines a sleeve including a sealing diaphragm in the bore thereof, with the sleeve constituting an extension of the flexible thermoplastic tubing. Accordingly, a piercing spike may sealingly enter the sleeve to rupture the diaphragm.

6 Claims, 3 Drawing Figures

PARENTERAL SOLUTION CONTAINER FOR ASEPTIC MIXING

BACKGROUND OF THE INVENTION

This application relates to a flat-collapsible bag suitable for mixing one medicament or the like in aseptic and preferably sterile manner with another medicament.

For parenteral solution administration it is of course necessary to maintain the highest aseptic standards.

Particularly in the area of total parenteral nutrition, where a patient is completely maintained for significant periods of time by nutrients administered parenterally, there is a significant need for preserving sterility when the various nutrient solutions are mixed for administration. Specifically, when dextrose or other carbohydrate solutions are mixed with amino acid or protein hydrolyzate solutions, bacteria growth can be explosively rapid in the resulting mixture. So, particularly, care must be taken in such circumstances. On the other hand, it is of course clearly desirable to have a system which permits the safe mixing of parenteral solutions such as a dextrose or other carbohydrate solutions with an amino acid or protein hydrolyzate solution, while permitting the resulting mixture to be stored for a period of time.

Furthermore, once the connection between containers for mixing parenteral solutions is made, there is a need for a tamperproof seal to be provided, so that the connection between the containers may be broken and the emptied container discarded, while the container full of the mixed parenteral solution materials retains a reliable seal.

In a present system, a standard Viaflex® container, which is a flat, collapsible bag manufactured by Travenol Laboratories, Inc., is initially about half-filled with a parenteral solution such as 50% dextrose. Protein hydrolyzate solution may be administered into the Viaflex bag through the end spike of an administration set which passes through a diaphragm port of the Viaflex bag, which diaphragm port is carried by the peripheral heat seal of the bag.

After the protein hydrolyzate has passed through the set into the bag, filling it, the flexible tubing of the set may be conventionally sealed, and then cut so that the spike penetrating into the port of the Viaflex bag, and a sealed section of tubing connected to the spike, serves as a seal.

However, such a system is not tamperproof in that the spike can be removed from its port and then reinserted, which can cause a break of sterility and may institute the explosive growth of bacteria mentioned above. For example, upon refrigeration of the bag, the spike may shrink and loosen in the port, becoming more likely to slip out.

Also, if the spike is dislodged from its sealing position in the access port of the Viaflex bag, the contents of the bag can be spilled.

By this invention, a tamperproof system is provided for providing an aseptic communication port for a partially filled parenteral solution container for receiving a second parenteral solution for mixing. The improvement of this invention also provides a more easily handleable and manipulatable access port as well.

DESCRIPTION OF THE INVENTION

In accordance with this invention a flexible, flat-collapsible bag containing parenteral solution and adapted for aseptically receiving and mixing the contents of another container is provided. The flat-collapsible bag initially contains, prior to receiving the contents of the other container, a liquid for parenteral administration. The bag also defines at least a pair of access ports, one of the ports being sealingly connected to flexible, crimpable thermoplastic tubing of a length of at least 1½ inches, with the sealed connector member being carried on the outer end of the flexible thermoplastic tubing.

The sealed connector member defines a sleeve including a sealing diaphragm in the bore thereof. The sleeve constitutes an extension of the flexible, thermoplastic tubing. As the result of this, a piercing spike, for example from an administration set or attached to another container, may sealingly enter the sleeve to rupture the diaphragm.

After this rupturing connection has been made and the desired material has been passed through the flexible, crimpable thermoplastic tubing, the thermoplastic tubing may be conventionally crimped by folding the tubing double and retaining the folded tubing in a clamp, using conventional tube sealing apparatus for this purpose. Alternatively, the flexible thermoplastic tubing may be permanently sealed by means of a transverse heat seal to occlude its bore, by means of conventional tube heat-sealing apparatus which has been previously utilized with the sealing of tubes of blood bags and the like, for example, the Hematron® tube sealing apparatus, sold by the Fenwal Division of Baxter Travenol Laboratories, Inc. Thereafter, the piercing spike may be removed from the sealed connector member, so that the container of this application may be separate once again, while at the same time retaining a sterile, hermetic seal of the crimped or otherwise sealed thermoplastic tubing.

In the drawings, FIG. 1 is a plan view of a container made in accordance with this invention, lying next to an auxiliary bag adapted for connection with the bag of this invention for the aseptic transfer of its contents to the bag of this invention, for mixing of parenteral solutions.

Figure 1:
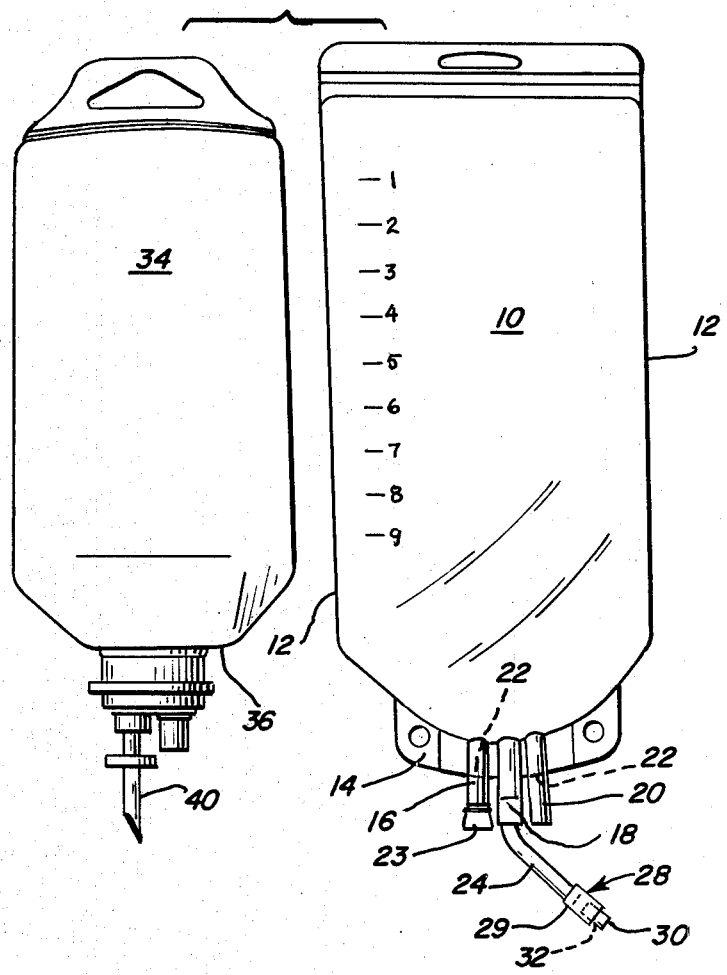
Figure 2:
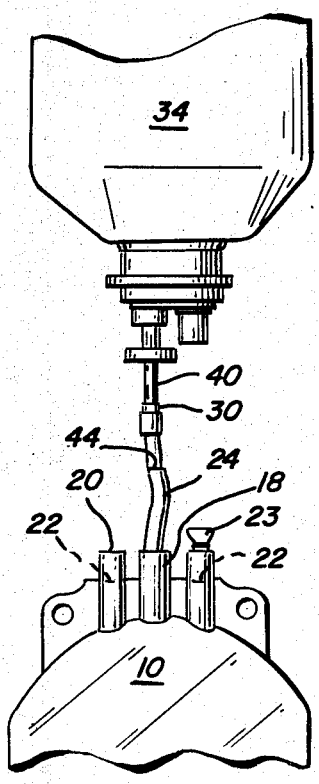
FIG. 2 is a detailed plan view showing the crimpable thermoplastic tubing and sealed connector member of this invention after connection with a spike and tubing communicating with the auxiliary bag, as shown in FIG. 1.
Figure 3:
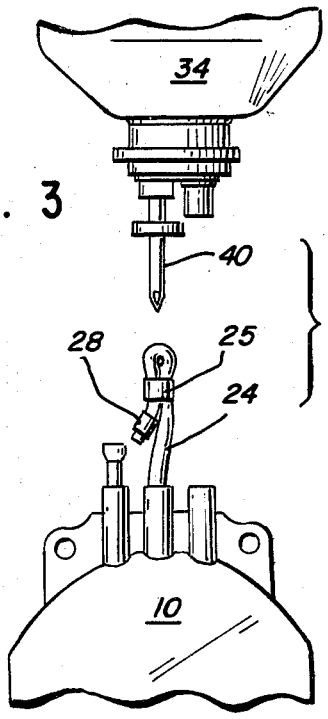
FIG. 3 is a plan view illustrating a subsequent step of use of the container of this invention, in which the spike of the auxiliary bag is removed after the crimpable thermoplastic tubing has been permanently sealed by crimping and clamping.

Referring to the drawings, the flexible, flat-collapsible bag 10 of this invention contains parenteral solution, and is adapted for aseptically receiving and mixing the contents of another container. Bag 10 may be of the basic design, for example, of the Viaflex container described above, but modified as specified herein, although other designs of flat-collapsible bags may also be modified in accordance with this invention.

Typically, bag 10 of this invention may contain from 30 to 70 percent of its holding capacity, and typically about 50 percent, of a concentrated parenteral solution, for example 50% dextrose injection. In this specific instance, such a solution is too concentrated to be injected into a peripheral vein, but may be slowly administered through an arterial catheter to provide the patient with a maximum amount of nutrient and a minimum amount of liquid, as is often required by patients with reduced kidney function who require total parenteral nutrition for a significant length of time.

Bag 10 has a heat seal 12 extending about its periphery to provide the hermetic seal, and may be made of polyvinyl chloride, for example. End seal 14 includes three access ports 16, 18, 20. Ports 16 and 20 may be closed with an internal diaphragm 22 for added sterile sealing.

Port 16 may be closed with a latex, puncturable injection site 23 of conventional design, so that supplemental medication may be added to the container.

Port 20 may be a standard port for receiving the spike of an administration set, which punctures diaphragm 22 for access to the contents of the bag.

Port 18 is provided as a port for receiving an aliquot of sterile solution from another parenteral solution container, to mix the contents of the two containers and to store them in bag 10.

Flexible, crimpable thermoplastic tubing 24 may be telescopically sealed by solvent sealing or the like to port 18 in flow communication therewith, with the tubing 24 being typically of a polyvinyl chloride formulation. Sealed connector member 28 is carried on the outer end of flexible tubing 24.

Connector member 28 defines first sleeve member 29 of larger inner diameter, sealingly fitting in telescoping manner about the outer end of the flexible, thermoplastic tubing 24. First sleeve 29 communicates in telescopic relation with second sleeve 30, in which second sleeve 30 fits in the bore of first sleeve 29. Second sleeve 30 carries a puncturable diaphragm 32 which is positioned across its bore, typically in a position adjacent to the outer end of first sleeve 29.

Accordingly, first sleeve 29 serves as a highly suitable gripping member, while at the same time providing a hermetic seal between tube 24 and second sleeve 30.

Second sleeve 30 is preferably relatively flexible, and may be made by molding as a single piece, including diaphragm 32. The flexibility of the second sleeve 30 improves the sealing characteristics thereof with a penetrating spike.

Also, it is preferred for the crimpable thermoplastic tubing 24 to be at least 1½ inches long and preferably two or more inches in length, which provides an improved opportunity for manual manipulation of the connector 28, for ease of the connecting operation with a spike, and also for reliable aspetic penetration thereof.

Furthermore, the length of tubing 24 provides an extension permitting connector 28 to penetrate out of the shell of a vacuum suction device which may be used to hasten the transfer of the contents from an auxiliary container to container 10 when connection is made, for example the Viavac ® unit sold by Travenol Laboratories, Inc.

Auxiliary container 34, shown in FIG. 1, may be of any design, but is specifically shown to be of a design as disclosed in U.S. patent application Ser. No. 126,228 filed Mar. 3, 1980. The container, which is wedge shaped in its original form, collapses flat except for shoulder 36 to expel essentially all the contents of the container.

Sealed to auxiliary container 34 is a penetrating spike 40 on its outer end of conventional design. Optionally, flexible tubing may be provided between spike 40 and container 34. The penetrating spike 40 may be maintained in sterile condition by a conventional outer seal.

In one embodiment, auxiliary container 34 may include an amount of parenteral protein hydrolyzate solution containing amino acids in a volume which corresponds to about 30 to 70 percent of the holding capacity of collapsible bag 10 and typically an amount corresponding to about 50 percent of the holding capacity.

Spike 40 penetrates second sleeve 30, passing through diaphragm 32 to obtain an aseptic liquid connection between the two bags by means of tubing 24 and 38. Accordingly, the contents of auxiliary container 34 may pass into bag 10, causing mixture of the dextrose and protein hydrolyzate, resulting in the creation of a solution which is adequate for total parenteral nutrition of a patient, and providing minimum nutritional maintenance for an indefinite period of time. As stated before, a vacuum chamber such as the Viavac unit may be used to hasten the process.

Following this, tubing 24 may be crimped by being folded double and clamped by means of a conventional tube clamping device which utilizes a staple-like clip 25 to permanently close off flow through tube 24 in a hermetic, aseptic manner. Alternatively, seal line 44 may be formed in tubing 24 at the location indicated by means of a Hematron heat sealing device as described above or an equivalent device.

Following this, spike 40 may be removed from connector member 28 without any compromise of the sterility of the contents of the now-filled bag 10. Bag 10 is then preferably put to immediate therapeutic use, or stored for a few hours in a refrigerator if desired, prior to use.

The container of this invention may alternatively be of a design which collapses incompletely rather than flat, if desired.

When use is desired, a conventional administration set may make penetration of the container through port 20. Conventional administration through an arterial set or the like may be effected.

The above has been offered for illustrative purposes only, and is not to be considered to limit the scope of the invention of this application, which is as defined in the claims below.

That which is claimed is:

1. A flexible, collapsible container, carrying therewith a volume of solution comprising from 30 to 70 percent of the holding capacity of said collapsible container, said solution being selected from the group consisting of a carbohydrate parenteral solution and an amino acid nutrient parenteral solution, said container defining at least a pair of access ports, one of the ports being sealingly connected to a flexible, crimpable, thermoplastic tubing length of at least 1½ inches, and a sealed connector member carried on the outer end of said flexible thermoplastic tubing, said sealed connector member defining a sleeve including a sealing diaphragm in the bore thereof, said sleeve constituting an extension of said flexible thermoplastic tubing, and a second container which includes the other type of said parenteral solutions in a volume approximately corresponding to the remaining empty volume of said first flexible collapsible container, said second container having a piercing spike positioned in said sleeve in sealingly-entered and diaphragm-rupturing relationship therewith, for transfer of the contents between said containers.

2. The collapsible bag of claim 9 in which said sleeve comprises a first sleeve member of larger inner diameter sealingly fitting about the outer end of said flexible thermoplastic tubing, said first sleeve member communicating in telescopic relation with a second sleeve, said second sleeve fitting in the bore of said first sleeve member, and said diaphragm being positioned within the bore of said second sleeve.

3. The collapsible bag of claim 2 in which said diaphragm within the bore of said second sleeve is positioned adjacent the outer end of said first sleeve.

4. The flexible, collapsible container system of claim 1 in which said first container initially contains essentially 50 percent by volume of a glucose solution and said second container initially carries essentially 50 percent by volume of said protein based nutrient solution in a volume suitable to be received and held by said first container.

5. The flexible, collapsible container system of claim 1 in which said first container is a collapsible bag of polyvinyl chloride plastic and the second container is flat-collapsible and wedge-shaped in its initial form, prior to collapse.

6. The flexible, collapsible container of claim 1 in which said second container is flexible and collapsible.

* * * * *

UNITED STATES PATENT AND TRADEMARK OFFICE

CERTIFICATE OF CORRECTION

PATENT NO. : 4,336,802

DATED : June 29, 1982

INVENTOR(S) : Albert L. Stone, Michael D. Nissen

It is certified that error appears in the above-identified patent and that said Letters Patent are hereby corrected as shown below:

Under the heading "References Cited" on page 1, change the first three references to indicate patent application numbers as follows:

U.S.S.N. 90,235 11/1979 Bellamy et al.

U.S.S.N. 91,688 11/1979 Bellamy et al.

U.S.S.N. 968,241 12/1978 DeVries et al.

At column 4, line 65, change claim 2 to read:

2. The collapsible bag of Claim 1 in which said sleeve . . .

Signed and Sealed this

*Sixteenth* Day of *November 1982*

[SEAL]

*Attest:*

GERALD J MOSSINGHOFF

*Attesting Officer*

*Commissioner of Patents and Trademarks*